US007938196B2

(12) United States Patent
Fischer et al.

(10) Patent No.: US 7,938,196 B2
(45) Date of Patent: May 10, 2011

(54) HAND-HELD POWER TOOL WITH VIBRATION-COMPENSATING MASS

(75) Inventors: Axel Fischer, Wiedergeltingen (DE); Michael Weber, Eichenau (DE)

(73) Assignee: Hilti Aktiengesellschaft, Schaan (LI)

( * ) Notice: Subject to any disclaimer, the term of this patent is extended or adjusted under 35 U.S.C. 154(b) by 244 days.

(21) Appl. No.: 12/386,519

(22) Filed: Apr. 17, 2009

(65) Prior Publication Data

US 2010/0263893 A1 Oct. 21, 2010

(51) Int. Cl.
*B25D 11/00* (2006.01)

(52) U.S. Cl. ..... 173/162.2; 173/201; 173/210

(58) Field of Classification Search ..... 173/47, 173/48, 210, 211, 162.1, 162.2, 201; 267/137, 267/141.1, 207, 141.12; 16/116 R, 431
See application file for complete search history.

(56) References Cited

U.S. PATENT DOCUMENTS

| | | | | |
|---|---|---|---|---|
| 4,478,293 | A * | 10/1984 | Weilenmann et al. | 173/162.2 |
| 5,025,870 | A * | 6/1991 | Gantner | 173/162.2 |
| 6,076,616 | A * | 6/2000 | Kramp et al. | 173/162.2 |
| 7,252,157 | B2 * | 8/2007 | Aoki | 173/162.2 |
| 7,383,895 | B2 * | 6/2008 | Aoki | 173/201 |
| 7,500,527 | B2 * | 3/2009 | Fischer et al. | 173/162.2 |
| 7,588,097 | B2 * | 9/2009 | Kamegai et al. | 173/162.1 |
| 7,610,967 | B2 * | 11/2009 | Fischer et al. | 173/162.2 |
| 7,637,328 | B2 * | 12/2009 | Sato | 173/162.2 |
| 7,762,348 | B2 * | 7/2010 | Stirm et al. | 173/162.2 |
| 7,766,096 | B2 * | 8/2010 | Satou et al. | 173/162.2 |

* cited by examiner

*Primary Examiner* — Scott A. Smith
(74) *Attorney, Agent, or Firm* — Abelman, Frayne & Schwab

(57) ABSTRACT

A hand-held power tool includes a main handle, a percussion mechanism striking along a percussion axis, a counter mass displaceable along an oscillation axis which is inclined to the percussion axis and biasing elements for preloading the counter mass to a rest position on the oscillation axis. The counter mass is arranged such that the rest position is closer to the main handle than the center of gravity is to the main handle.

11 Claims, 1 Drawing Sheet

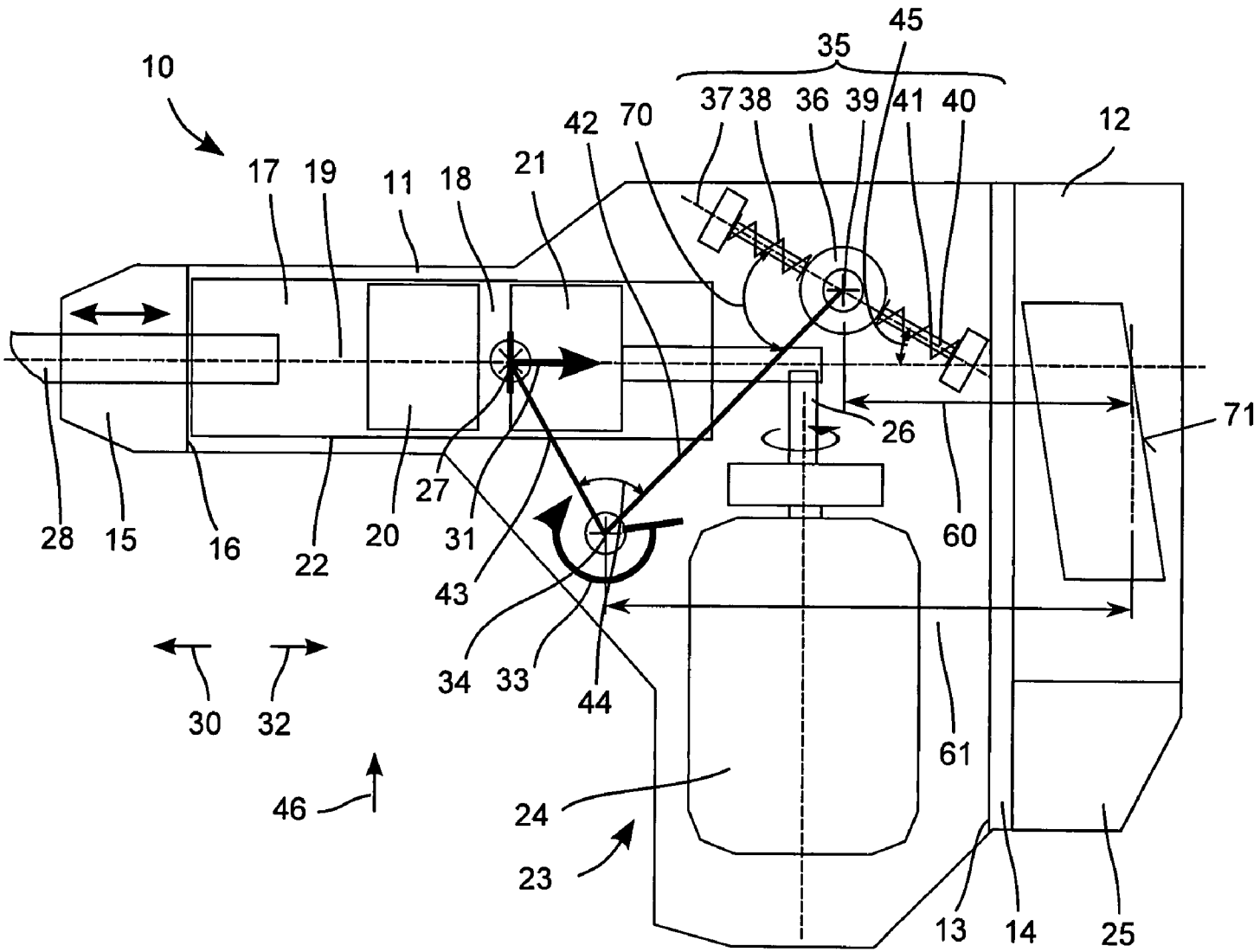
10
11
12
13
14
15
16
17
18
19
20
21
22
23
24
25
26
27
28
30
31
32
33
34
35
36
37
38
39
40
41
42
43
44
45
46
60
61
70
71

HAND-HELD POWER TOOL WITH VIBRATION-COMPENSATING MASS

BACKGROUND OF THE INVENTION

1. Field of the Invention

The present invention relates to a hand-held power tool with a vibration-compensating mass.

2. Description of the Prior Art

European Publication EP 1 736 283 discloses a hand-held hammer drill. A hammer mechanism repetitively strikes on a tool bit end in a tool bit holder. Vibrations of the hammer mechanism are damped by a tuned mass damper which is placed adjacent and above the hammer mechanism. The tuned mass damper comprises a counter mass slideably supported on rods above the hammer mechanism. Springs are biasing the counter mass to a position of rest. The counter mass moves in forward and rearward direction, parallel to the striking movement of the hammer mechanism against the springs such to counteract vibrations generated by the operation of the hammer mechanism.

An object of the present invention is to realize improved ergonomic hand-held power tools.

SUMMARY OF THE INVENTION

This and other objects of the present invention are achieved by a hand-held power tool comprising a main handle, a percussion mechanism striking along a percussion axis, a counter mass displaceable along an oscillation axis and biasing means preloading the counter mass to a position of rest on the oscillation axis. The counter mass is arranged such that the position of rest being is closer to the main handle than the center of gravity is to the main handle. Further, the oscillation axis is inclined to the percussion axis.

The arrangement of the counter mass, i.e. its position of rest, close to the main handle showed to improve the handling of the power-tool. It was revealed that a damping by the oscillating counter mass can be still obtained. A good damping made it necessary to incline the oscillation axis with respect to the percussion axis.

The main handle is usually arranged opposite to a tool chuck. The main handle may have a grip bar for one or two hands.

The percussion mechanism may be at least one of a pneumatic percussion mechanism, a motor-driven pneumatic percussion mechanism and a clutch mechanism.

A first distance from the handle to the position of rest of counter mass may be at the most 75 percent of a second distance from a handle of the hand-held power tool to the center of gravity. The distance may be measured projected on the percussion axis. A reference point on the handle may be chosen by the grip surface which shows in forward direction, i.e. in direction of the center of gravity. Favourably, the first distance is at the most 50 percent of the second distance.

A first imaginary lever and a second imaginary lever may define an angle of at least 10 degrees and at the most 80 degrees, the first imaginary lever connecting the center of gravity with the position of rest and the second imaginary lever connecting the center of gravity with a center of the percussion mechanism.

A first imaginary lever and a second imaginary lever may define defining a first angle, the first imaginary lever connecting the center of gravity with the position of rest and the second imaginary lever connecting the center of gravity with a center of the percussion mechanism, and the oscillation axis and the percussion axis may define a second angle, wherein the second angle is in a range of 20 percent to 90 percent of the first angle. The relation of the first and second angle showed best overall damping results for both longitudinal and rotational vibration motions. In particular, values of at least 40 percent and at the most of 75 percent gave best results. The first angle may be at least five degrees.

The center of the motor-driven pneumatic percussion mechanism can be identified to be a center position of an excitation piston or cylinder. The center of a clutch mechanism can be the identified to be the contact surface of the axially stationary part.

An imaginary lever and the oscillation axis may define an angle of at least 30 degrees and at the most 80 degrees, the imaginary lever connecting the center of gravity with the position of rest.

The oscillation axis and the percussion axis may define an angle which is in a range of at least 5 degrees and at the most of 60 degrees.

The position of rest and the center of gravity may be on opposite sides of the percussion axis. A handling of the hand-held power tool is assumed to be better when the center of gravity is close to the percussion axis. The weighty tuned mass damper balances the heavy driving mechanism, e.g. an electric motor, so improved handling is obtained.

Thus, a long imaginary first lever ensures a high torsional momentum of the counter mass acting around the center of gravity.

The hand-held power tool may be a hand-held power drill.

The novel features of the present invention, which are considered as characteristic for the invention, are set forth in the appended claims. The invention itself, however, both as to its construction and its mode of operation, together with additional advantages and objects thereof, may be best understood from the following detailed description of the invention, when read with reference to the accompanying drawings.

BRIEF DESCRIPTION OF THE DRAWING

In the drawing:

FIG. 1 shows a schematic view of an inventive hand-held power tool.

DETAILED DESCRIPTION OF THE PREFERRED EMBODIMENT

FIG. 1 illustrates an embodiment of a hand-held power tool 10. The power tool 10 may be a rotary impact drill or a chipping hammer, for instance.

The power tool 10 has a machine housing 11 and a handle 12 attached to a rear side 13 of the machine housing 11. The handle 12 has a grip surface 71 for the fingers. The handle 12 may be decoupled from the machine housing 11 by damping, elastic elements 14. The damping elements 14 are designed to have a low-pass characteristic. A tool chuck 15 may be part of the machine housing 11 or detachably fixed to a front side 16 of the machine housing 11.

A percussion mechanism 17 is arranged inside the machine housing 11.

An exemplary percussion mechanism 17 may be a motor-driven pneumatic percussion mechanism. A pneumatic chamber 18 is enclosed along a percussion axis 19 on one side a flying piston 20 and on an opposite side by an excitation piston 21. Other walls of the pneumatic chamber 18 which are parallel to the percussion axis 19 may be formed by at least one of a guiding cylinder 22, the flying piston 20 and the excitation piston 21. The pneumatic chamber 18 is sealed such that a pressure inside the pneumatic chamber 18 depends on the relative position of the flying piston 20 and the excitation piston 21.

The excitation piston 21 is driven along the percussion axis 19 by a drive mechanism 23. The drive mechanism 23 may comprise an electric motor 24. The electric motor 24 may be powered by a rechargeable battery pack 25 or by a power grid. An eccentric tappet 26 translates the rotational motion of the electric motor 24 to an axial motion along the percussion axis 19. The excitation piston 21 is coupled to the drive mechanism 23 and, thus, moves periodically forward and backward along the percussion axis 19. The pneumatic chamber 18 periodically increases and decreases its volume. A center 27 of the pneumatic chamber 18 may be defined to be on half the way between turning points of an inner side of the excitation piston 21.

The periodic movement of the excitation piston 21 excites a periodic movement the flying piston 20 via the pneumatic chamber 18. The flying piston 20 transfers its impulse to a tool bit 28 when the flying piston 20 hits directly on the tool bit 28 or by means of an intermediate striker. A striking frequency corresponds to the periodicity of the movement of the flying piston 20 and, hence, to the speed of the motor 24.

Forces 29 applied to the flying piston 20, which accelerate the flying piston 20 in forward direction 30, are balanced by counterforces 31 acting in backward direction 32. The exerted counterforces 31 contribute to a vibration level. A spectral distribution of the vibration is predominately concentrated at a peak at the striking frequency causing high amplitude of the vibrational motion. Firstly, the periodic counterforces 31 do cause a linear vibrational motion in parallel to the percussion axis 19. Secondly, the counterforces 31 do cause a torsional moment 33 around a center of gravity 34 of the hand-held power tool 10 which the user perceives as a rotational vibration motion around the center of gravity 34 or as a combined vertical vibration and back-and-forth vibration of the handle 12.

The location of the center of gravity 34 may be dominated by heavy parts which are the percussion mechanism 17, the drive mechanism 23, the rechargeable battery pack 25 and a tool engaged to the tool chuck 15. An ergonomic design of the hand-held power tool 10 may request for an arrangement of the drive mechanism 23 and the rechargeable battery pack 25 displaced from the percussion axis 19. Therefore, the center of gravity 34 does not lye on the percussion axis 19, but may be in an area below the percussion axis 19, in particular below the pneumatic chamber 18.

A tuned mass damper 35 is arranged within the machine housing 11. The tuned mass damper 35 is a near-resonant damping mechanism. The tuned mass damper 35 comprises a counter mass 36 which may oscillate along an oscillation axis 37. A restoring element 38 forces the counter mass 36 back to a position of rest 39 on the oscillation axis 37. The tuned mass damper 35 is preferably a linear tuned mass damper 35 whom counter mass 36 moves along a straight line, i.e. the tuned mass damper 35 has predominantly a linear motion. The linear tuned mass damper 35 can be constructed by simple elements. Rods 40 may be guiding the counter mass 36 and spiral springs 41 are acting as restoring elements 38 which are seated on the rods 40 on both sides of the counter mass 36. The tuned mass damper 35 may be housed by an encapsulating housing. The housing may guide the counter mass 36 instead of guiding rods 40.

The mass of the counter mass 36 and the restoring forces of the restoring element 38 define a resonance frequency of the tuned mass damper 35. The resonance frequency is chosen to be equal to the striking frequency such that the tuned mass damper 35 becomes resonantly excited by the periodic counterforces 31. An efficient energy transfer from the vibration to the tuned mass damper 35 is enabled because of the resonant excitation. The tuned mass damper 35 swings with the striking frequency but by approximately 90 degrees out of phase with respect to the percussion mechanism 17. The coupled system of tuned mass damper 35 and percussion mechanism 17 transfers energy of vibrations at the striking frequency to higher harmonics of the striking frequency. The amplitude of the vibrational motion is thus lowered compared to a percussion mechanism 17 without a tuned mass damper 35.

It is most intuitive to place the tuned mass damper right above the pneumatic chamber 18 of the percussion mechanism 17 in a collinear arrangement because the cause of vibrations and its damping element are closest possible. The collinear motions of the percussion mechanism 17 and the damping mechanism are optimally coupled and, hence, a maximum reduction of the linear vibration's amplitude would be gained. By a lucky coincidence this arrangement very effectively reduces rotational vibrations, as well. A fictional lever which connects the center of gravity 34 with the tuned mass damper would be orthogonal to the tuned mass damper and allows for an optimal coupling of the rotation vibrational motion to the tuned mass damper. Thus, for such a configuration a consideration of rotational vibration could be ignored as optimizing a damping of the linear vibrational motion leads to an optimal damping of the rotational vibration.

Ergonomic considerations revealed that a location of the weighty tuned mass damper 35 close to the handle 12 is to be preferred. A static torque a user has to maintain at the handle 12 for holding the power tool 10 is lowered. Preferably, the tuned mass damper 35 is arranged closer, in direction of the percussion axis 19, to the handle 12 than the percussion mechanism 17 or the pneumatic chamber 18. Satisfactory ergonomic results have been obtained for tuned mass dampers 35 whom position of rest 39 is arranged in a distance 60 to the handle 12 being shorter than 75 percent, preferably less 50 percent, the distance 61 of the handle 12 to the center of gravity 34. The distances 60, 61 are to be measured in projection on the axis of percussion 19. The reference on the handle 12 may be grip surface 71 which shows in direction to the tool chuck 15.

A first imaginary lever 42 connects the position of rest 39 with the center of gravity 34 and a second imaginary lever 43 connects the center 27 of the pneumatic chamber 18 and the center of gravity 34. The first imaginary lever 42 and the second imaginary lever 43 are inclined by a first angle 44. The first angle 44 may be larger than 5 degrees and/or less than 80 degrees.

The oscillation axis 37 of the tuned mass damper 35 is inclined with respect to the percussion axis 19 by a second angle 45. The second angle 45 may be chosen depending on the first angle 44. The second angle 45 may be at least 20 percent and at the most 90 percent of the first angle 44, e.g. at least 30 percent, at least 50 percent, at the most 75 percent.

The damping of the linear vibrational motion and the rotational vibrational motion by the tuned mass damper 35 are partially decoupled. A collinear arrangement, i.e. a second angle 45 of zero degrees, reduces best the linear vibrational motion, however, gives poor results for the rotational vibrational motion. An optimal damping of the rotational vibrational motion leads to an insufficient damping of the linear vibrational motion. Ergonomic studies revealed a good overall performance of the tuned mass damper 35 for damping all vibrational motion can be achieved for the range of the second angle 45 mentioned above. The second angle 45 may be chosen to provide a higher damping of the linear vibrational motion along the percussion axis 19 compared to the rotational vibrational motion. A ratio of the damping quality may be specified by accelerations along the percussion axis 19 and a vertical direction 46 perpendicular to the percussion axis 19. A ratio of the acceleration along the percussion axis 19 to the vertical acceleration is in a range of 25 percent to 80 percent with the installed tuned mass damper 35 at the second angle 45 chosen. The first imaginary lever 42 and the oscillation axis 37 may, therefore, define an angle 70 in the range of at least 30 degrees and at the most of 80 degrees, for instance.

The drop in damping the vibrational motion compared to the optimal collinear and adjacent arrangement of the tuned mass damper 35 and the pneumatic chamber 18 are outweigh by the improved static ergonomic properties.

The tuned mass damper 35 may be arranged such that its position of rest 39 is above the percussion axis 19. The long first imaginary lever 42 ensures a high torque of the tuned mass damper 35 with respect to the center of gravity 34. Thus, an efficient damping of the rotational vibration motion can be achieved even with a low mass of the counter mass 36.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A hand-held power tool, comprising a main handle, a percussion mechanism striking along a percussion axis, a counter mass displaceable along an oscillation axis which is inclined to the percussion axis, and biasing means for preloading the counter mass to a rest position on the oscillation axis, the rest position being closer to the main handle than a center of gravity of the power tool is to the main handle.

2. The hand-held power tool according to claim 1, wherein a first distance from the main handle to the position of rest of the counter mass is at the most 75 percent of a second distance from the main handle of the hand-held power tool to the center of gravity.

3. The hand-held power tool according to claim 2, wherein the first distance and the second distance are measured in projection onto the percussion axis.

4. The hand-held power tool according to claim 2, wherein the first and second distances are measured to a grip surface of the main handle which shows towards the center of gravity.

5. The hand-held power tool according to claim 1, wherein a first imaginary lever and a second imaginary lever are defining an angle of at least 10 degrees and at the most 80 degrees, the first imaginary lever connecting the center of gravity with the position of rest and the second imaginary lever connecting the center of gravity with a center of the percussion mechanism.

6. The hand-held power tool according to claim 1, wherein a first imaginary lever and a second imaginary lever are defining a first angle, the first imaginary lever connecting the center of gravity with the position of rest and the second imaginary lever connecting the center of gravity with a center of the percussion mechanism, and the oscillation axis and the percussion axis are defining a second angle, wherein the second angle is in a range of 20 percent to 90 percent of the first angle.

7. The hand-held power tool according to claim 6, wherein the first angle is larger than five degrees.

8. The hand-held power tool according to claim 1, wherein an imaginary lever and the oscillation axis are defining an angle of at least 30 degrees and at the most 80 degrees, the imaginary lever connecting the center of gravity with the position of rest.

9. The hand-held power tool according to claim 1, wherein the oscillation axis and the percussion axis are defining an angle which is in a range of at least 5 degrees and at the most of 60 degrees.

10. The hand-held power tool according to claim 1, wherein the position of rest and the center of gravity are on opposite sides of the percussion axis.

11. The hand-held power tool according to claim 1, wherein the percussion mechanism comprises a motor-driven pneumatic percussion mechanism.

* * * * *